US005323516A

United States Patent [19]

Hartmann

[11] Patent Number: 5,323,516

[45] Date of Patent: Jun. 28, 1994

[54] WATCH BAND OR BRACELET CLOSURE WITH MAGNETICALLY BIASED KEEPER

[76] Inventor: György Hartmann, Klapka U. 79, H-2084 Pilisszentivan, Hungary

[21] Appl. No.: 91,861

[22] Filed: Jul. 14, 1993

[51] Int. Cl.[5] ..... A44B 11/00

[52] U.S. Cl. ..... 24/303; 292/251.5

[58] Field of Search ..... 24/303, 94, 49 M, 688; 292/251.5; 63/14.1, 29.2; 335/285

[56] References Cited

U.S. PATENT DOCUMENTS

| | | | |
|---|---|---|---|
| 2,648,884 | 8/1953 | Loofboro | 24/303 |
| 3,293,714 | 12/1966 | Shafer | 24/303 |
| 3,589,341 | 6/1971 | Krebs | 24/303 |
| 5,008,984 | 4/1991 | Levy | 24/303 |
| 5,050,276 | 9/1991 | Pemberton | 24/303 |

FOREIGN PATENT DOCUMENTS

| | | | |
|---|---|---|---|
| 1050103 | 2/1959 | Fed. Rep. of Germany | 24/303 |
| 1226816 | 10/1966 | Fed. Rep. of Germany | 335/285 |
| 0605196 | 5/1960 | Italy | 24/303 |
| 0960115 | 6/1964 | United Kingdom | 24/303 |
| 1020334 | 2/1966 | United Kingdom | 24/303 |

*Primary Examiner*—Victor N. Sakran
*Attorney, Agent, or Firm*—Donald A. Bergquist

[57] ABSTRACT

A closure, buckle, or clasp for connecting two free ends of a strap, a belt, a necklace, or a harness is disclosed that relies upon a mechanical keeper to at least aid in keeping the closure in an engaged condition, wherein the mechanical keeper is of magnetic material and is biased in a locked position by means of the force field of a magnet, thereby eliminating all springs or snug-fitting elements that could wear or lose their effectiveness over time. The magnetic keeper and the magnet may be parts of the same clasp element or they may be parts in separate clasp elements that are joined to effect closure of the clasp.

9 Claims, 3 Drawing Sheets

WATCH BAND OR BRACELET CLOSURE WITH MAGNETICALLY BIASED KEEPER

BACKGROUND OF THE INVENTION

The present invention relates generally to clasps for ornamental items, such as watch bands, bracelets, necklaces and like articles, and pertains more specifically to a clasp wherein no spring biasing means nor snugly fitting members are employed; rather, magnetic attraction is used. The invention could also relate to clasps or buckles for belts, harnesses, or other apparatus employing straps to be releasably joined. The invention will be described in the context of a watch band.

Generally, this invention may be used with a leather strap, a mesh band, or a band made of multiple links joined on pivot axes that are substantially parallel to the width of the band, thereby providing flexibility to allow the band to wrap around the wrist of the wearer and also providing adjustability by the adding or the removing of links.

Many clasps for ornamental items rely on spring tension or compression or on the compressive elasticity of elements that fit snugly together either to retain the principal latch mechanism or to retain a cosmetic cover that hides the workings of the latch mechanism. With time and repeated use, many such clasps fail because of wear or permanent deformation of the spring means. Although some clasps continue to function, they may become a nuisance because of the failure of the cosmetic cover to stay in place owing to wear or permanent deformation of their retaining means.

SUMMARY OF THE INVENTION

Accordingly, it is an object of this invention to provide a clasp for a watch band or the like employing a mechanical keeper wherein no spring biasing means, nor compressive elasticity of its parts are required.

It is an object of this invention to provide such a clasp wherein a magnetically-biased mechanical keeper prevents the clasp from being inadvertently opened.

It is an object of this invention to provide such a magnetically-biased mechanical keeper that prevents the clasp from being inadvertently opened by interlocking two opposing sidewalls of a box with mating sidewalls of a cover for said box and wherein the keeper is held in such position by a magnet.

It is another object of this invention to provide such a magnetically-biased mechanical keeper that prevents the clasp from being inadvertently opened by means of a keeper within a first portion of a clasp engaging an opening in a second portion of the clasp, separable from the first portion, and wherein the keeper is held in such position by a magnet.

It is another object of this invention to provide such a magnetically-biased keeper that prevents the clasp from being inadvertently opened by providing a keeper in one portion of a clasp passing into an opening in a tongue of a second portion of a clasp and wherein the keeper is held in such position by a magnet.

It is a further object of this inventions to provide such a clasp wherein a mechanical keeper that is a part of one portion of the clasp is biased by a magnet in a separable second portion of the clasp.

It is a further object of this invention to provide such a clasp wherein a mechanical keeper that is a part of one portion of the clasp is biased by a magnet in the same portion of the clasp.

It is a further object of this invention to provide such a clasp that is especially easy to latch and unlatch, even by wearers who have impaired or reduced manual dexterity.

It is a further object of this invention to provide such a clasp wherein means are provided to create a smooth, finished, and attractive appearance to the clasp when latched.

DISCUSSION OF PRIOR ART

Clasps for ornamental items to be worn on the person have been the subject of much development throughout the many years over which people have decorated themselves with bracelets, necklaces, and like articles, including wrist watches, which are a recent and more utilitarian (though often quite ornamental) development relative to the other, largely ornamental, items described. The search for a clasp that at once is easy to open and close selectively, yet will not open inadvertently, has led to a wide variety of clasp arrangement providing various advantages and disadvantages. In addition, clasps for ornamental items should not detract from the aesthetic nature of the article in connection with which the clasp is utilized, a requirement that often calls for a compact, unobtrusive device, without unsightly appendages or voids. The clasp should also be capable of being constructed of a variety of materials including precious or semi-precious materials with acceptable economy of time and materials.

Magnetic clasps have been used on bands for wristwatches and the like. In U.S. Pat. No. 4,941,236, issued in 1990 to Sherman et al., there is taught a clasp wherein at least one portion is a magnet that is held by the magnetic force thereof to the mating portion. Ridged surfaces on the mating faces are used to increase the frictional engagement of the two portions. Some of these ridged surfaces might be seen to hold the clasp portions together, even without the magnetic attraction, but absent in the teachings is the use of a magnetically-biased mechanical keeper.

Other magnetic band closures have been taught in U.S. Pat. No. 3,589,341, issued in 1971 to Krebs, and in U.S. Pat. No. 4,197,618, issued in 1980 to Bourguignon. They do not include mechanical keepers of any sort.

Magnetic clasps have been used on jewelry, as taught in U.S. Pat. No. 2,615,227, issued in 1952 to Hornik, and in U.S. Pat. No. 2,648,884, issued in 1953 to Loofboro. Neither of these patents teach a magnetically-biased mechanical keeper, as used in the present invention.

DETAILED DESCRIPTION OF THE INVENTION

In this description of the invention, reference will be made to the figures described above, wherein like reference numbers have been assigned to like pieces in all of the figures.

Figure 1:
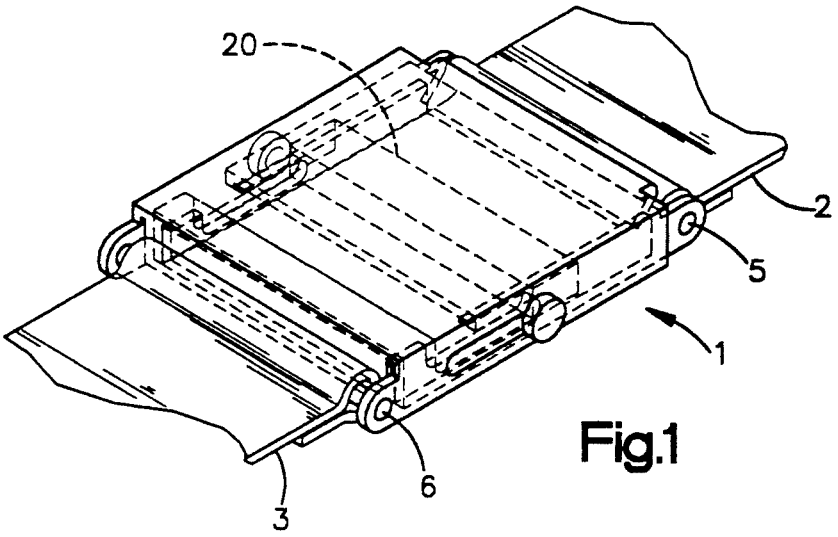
FIG. 1 presents a perspective view of a first embodiment of the invention in the engaged or clasped position as it would be worn on the person. Phantom lines show internal parts.

FIG. 1 shows the clasp of this invention in perspective view to show the appearance of the clasp 1 in its first, and preferred embodiment. The clasp, as herein shown and described, is principally designed for use in connecting two free ends of bands attacted to wrist watches, connects a first band end 2 with a second band end 3. In the preferred mode, all exposed surfaces shown in FIG. 1 have an attractive finish, being a precious metal or a precious metal alloy or coating; this is only for the sake of appearance, which is important in this field of art, but is not essential to the function of the clasp. The clasp would function as well were it made of inexpensive materials, even polymers or plastics.

The clasp elements are attached to each band end in the manner that is customary in the art, using spring pins 5 and 6 of common commercial use. The spring pins are not illustrated in detail because they are common and well known in the art.

Figure 2:
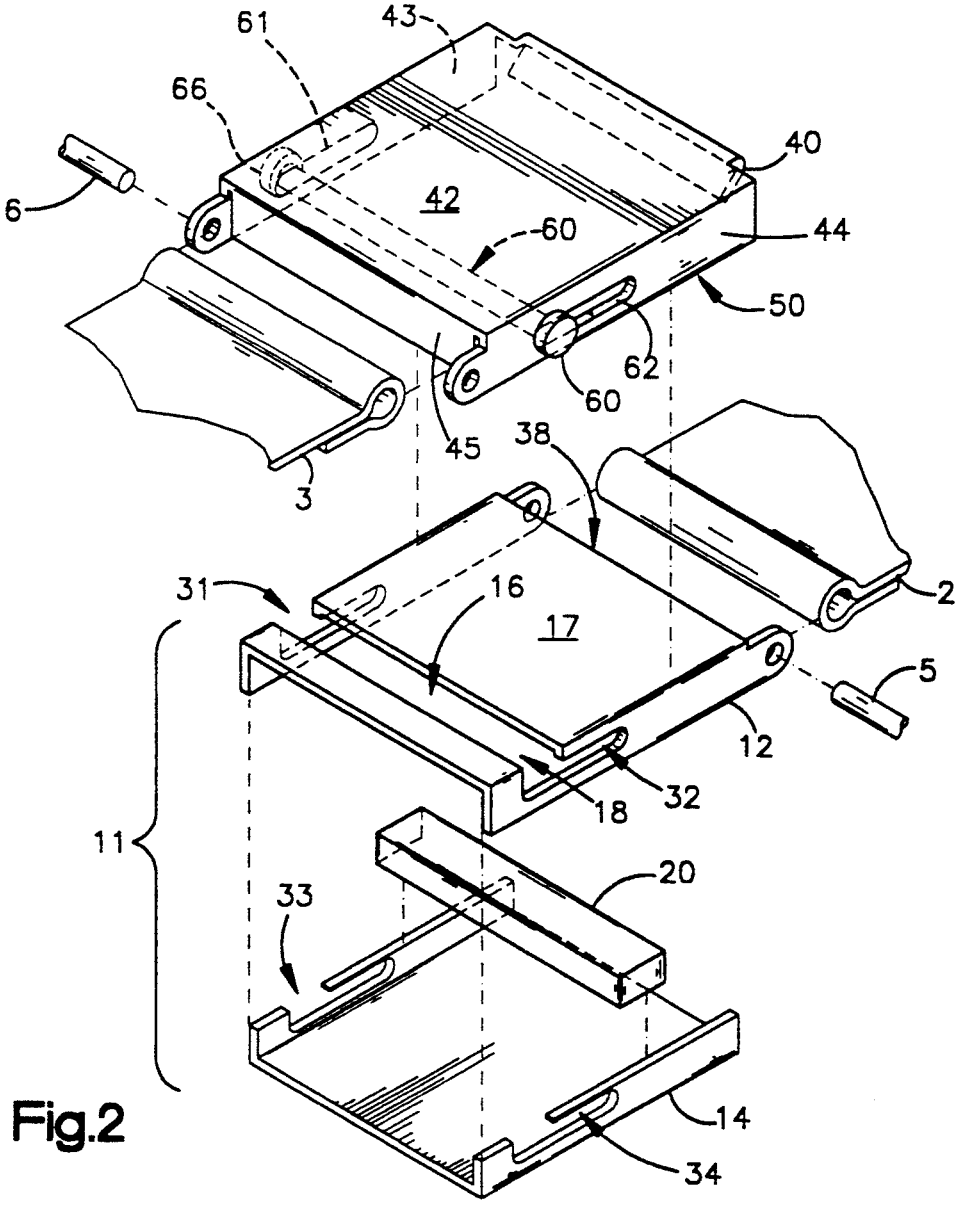
FIG. 2 presents an exploded perspective view of the clasp embodiment of FIG. 1 with the clasp disengaged.
Figure 3:
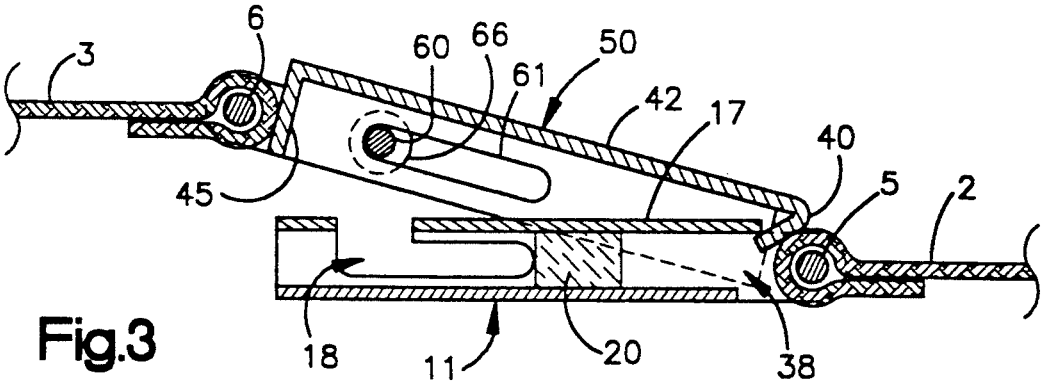
FIG. 3 presents a sectional view of the embodiment of FIG. 1 to show, with accompanying FIGS. 4 and 5 how the clasp operates and locks.
Figure 4:
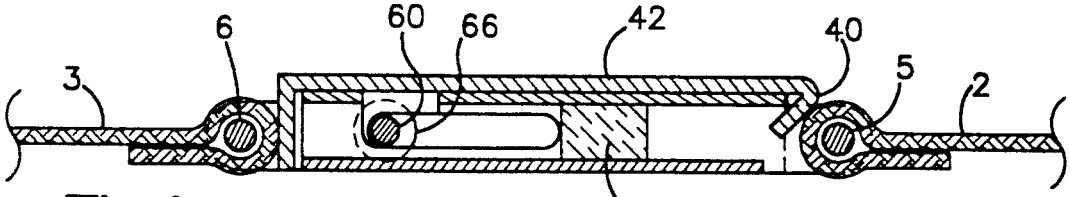
FIG. 4 presents a sectional view of the embodiment of FIG. 1 to show, with accompanying FIGS. 3 and 5 how the clasp operates and locks.
Figure 5:
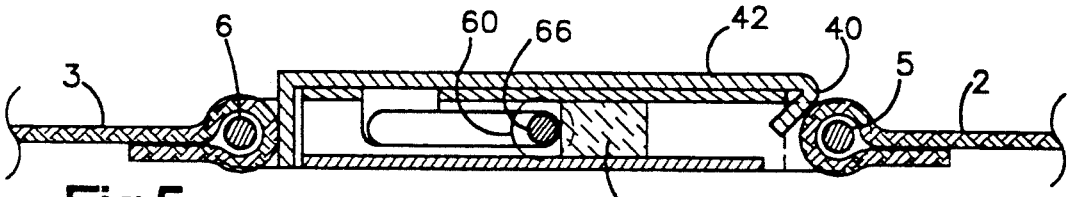
FIG. 5 presents a sectional view of the embodiment of FIG. 1 to show, with accompanying FIGS. 3 and 4 how the clasp operates and locks.

The working parts of the invention are more readily seen in the figures subsequent to FIG. 1. The disengaged clasp elements are presented in exploded view in FIG. 2. In this figure, it can be seen that the clasp includes a first element 10 that is a substantially closed box 11, in this mode formed of a top portion 12 and a bottom portion 14 cooperatively joined and attached at one end by a simple spring pin 5 to a first band end 2 and having a transverse opening 16 through its top wall 17 and enclosing a permanent magnet 20 positioned at the end opposite said opening.

Side walls 22 and 24 of the top portion 12 and side walls 26 and 28 of the bottom portion 14, have aligned L-shaped openings 31, 32, 33, and 34 therethrough that together are contiguous with the opening 16 in the top wall 17, thereby together the three openings form one continuous opening, the keeper slot 18.

A transverse end opening 38 in the box end proximal the band connection of this first element is adjacent to the top wall 17 and will be seen in subsequent description to receive a hook element 40, described below. In practice, this transverse end opening may be merely a transverse depression in an end wall to provide for receiving the tip of a hook element that engages the corner created by the end wall and the adjacent top wall 17. Also, in practice, the end wall could be totally absent, as is the case in the drawings, the void thus existing is capable of receiving the tip of a hook element 40 that engages the adjacent edge of the top wall 17. Herein we shall continue to call such a depression in the end wall or such absence of an end wall a transverse end opening.

The second clasp element in this embodiment is a cover 50 for the first element 11 described above. Said cover comprises a top cover wall 42 and two side cover walls 43 and 44 and a rear cover wall 45. The bottom of this cover 50 is open to receive the box of the first clasp element 11. Said cover is attached by a simple spring pin 6 engaging said two side walls 43 and 44 at a location adjacent the rear cover wall 45 thereof to the second band end 3.

The top cover wall 42 includes on the end distal from said rear cover wall 45 and band connection, a hook element 40 adapted to engage the transverse end opening 38 of the first element 11, thereby to connect the two band ends together. In the best embodiment, as illustrated, this hook element 40 is a transversely elongated hook that is made as an extension of the top wall 17. When the hook element is engaged in the transverse end opening 38 and the cover 50 is lowered to enclose the first clasp element 11, the rear wall 45 prevents the second clasp element 50 from moving in a direction that would allow the hook element 40 to disengage from the transverse end opening 38. Continued tension on the clasp from the two strap ends 2 and 3 would be sufficient to keep the clasp 1 closed as the tension, coupled with pressure of the wearer's wrist against the bottom wall of the first clasp element 11, would prevent the second clasp element 50 from lifting up to allow disengaging the hook 40, but a locking device is desirable. In this description, we refer to such a locking device as a "keeper", as it keeps the clasp closed.

The second clasp element 50 also includes a keeper element 60 that comprises a bar 65 that slides easily and is captively held by matching longitudinal openings 61 and 62 in the side walls 43 and 44, respectively. This bar is made of a magnetic material; that is, the bar is attracted to a magnet. The ends 66 of the keeper 60 protrude from the side walls 43 and 44 sufficiently to be touched and moved by one's fingertips. As the cover element 50 is first hooked onto the box element 11 by means of hook portion 40, the cover element 50 is lowered to surround the box element 11 while the keeper 60 enters the keeper opening 18. Then, the keeper 60 is urged by the influence of the field of the magnet 20 to move longitudinally in the side wall openings 61 and 62, which are now aligned with the openings in the box side walls, and toward the magnet 20, to a position where the keeper 60 is held by the force of the magnet 20, thereby to prevent the cover element 50 from being inadvertently lifted off the box element 11 to release the clasp 1.

It should be noted that with the keeper thus held in full engagement of the keeper slot 18, the rear wall 45 abutting the distal end of the box element 11, the hook portion 40 fully engaging the opening 38 and the side walls 43 and 44 preventing lateral displacement of the cover element 50 on the box element 11, the clasp may not be opened or inadvertently disengaged. Yet, the clasp may be easily opened, as will be described below.

This embodiment is notable in that the biasing means (i.e., the magnet 20) is in a clasp element that is separate from that which includes the keeper 60. One cannot image a spring-biased clasp wherein the biasing means and the keeper are in separable elements of the clasp.

To open the clasp from the closed position, the protruding ends 66 of the keeper 60 are manually moved against the biasing force of the magnet 20 in a direction away from the magnet 20 and toward the opposite end of the longitudinal openings 61 and 62 and the cover element 50 is then lifted to disengage the keeper 60 from the keeper slot 18, thereby to allow lifting the cover element 50 from the box element 11 and to then disengage the hook portion 40 from the transverse end opening 38. It is clear that there are no springs nor tight fits between elements of this clasp that might wear or loose their effectiveness.

A basic difference should be noted regarding a magnetically-biased keeper in contrast to a spring-biased keeper. In a spring-biased keeper, the keeper must be moved against a spring force that increases as the keeper is moved in a direction to release the clasp. In contrast, a magnet exerts its greatest force when the keeper is close to it, so that the biasing force from a magnet decreases as the keeper is moved in a direction against the biasing force to release the clasp. This fact makes releasing the magnetically-biased clasp easier for the user than it would be were a similar clasp produced with a spring biased keeper. Additionally, a magnet is not subject to breakage or the gradual loss of biasing force due to metal fatigue as is often experienced in springs.

Figure 6:
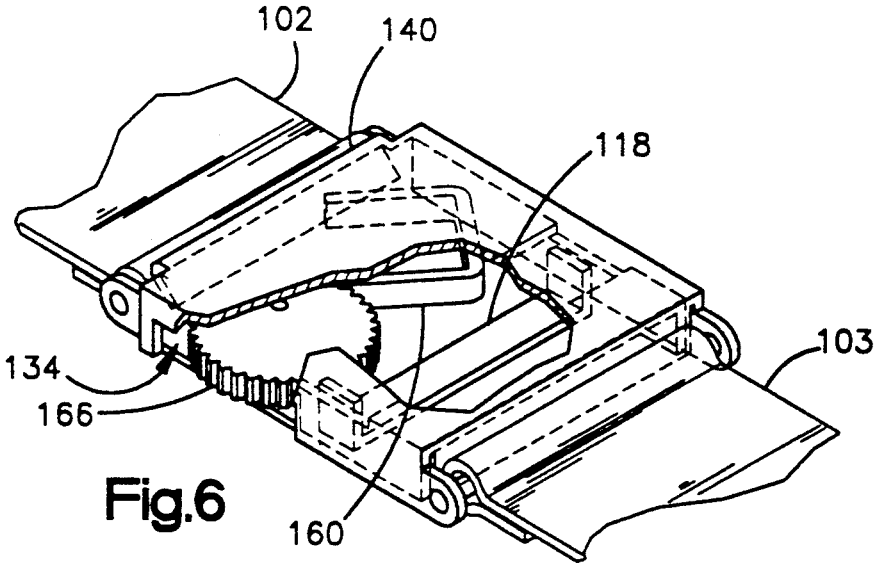
FIG. 6 presents a perspective view of a second embodiment of the invention in the engaged or clasped position with a portion cutaway to show the latch in an unlocked position.
Figure 7:
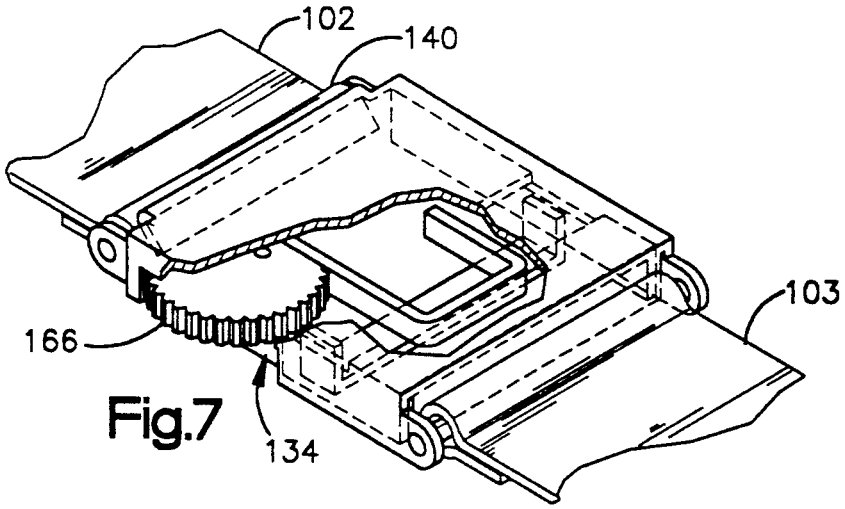
FIG. 7 presents the same cutaway perspective view of FIG. 6 showing the latch in a locked position.
Figure 8:
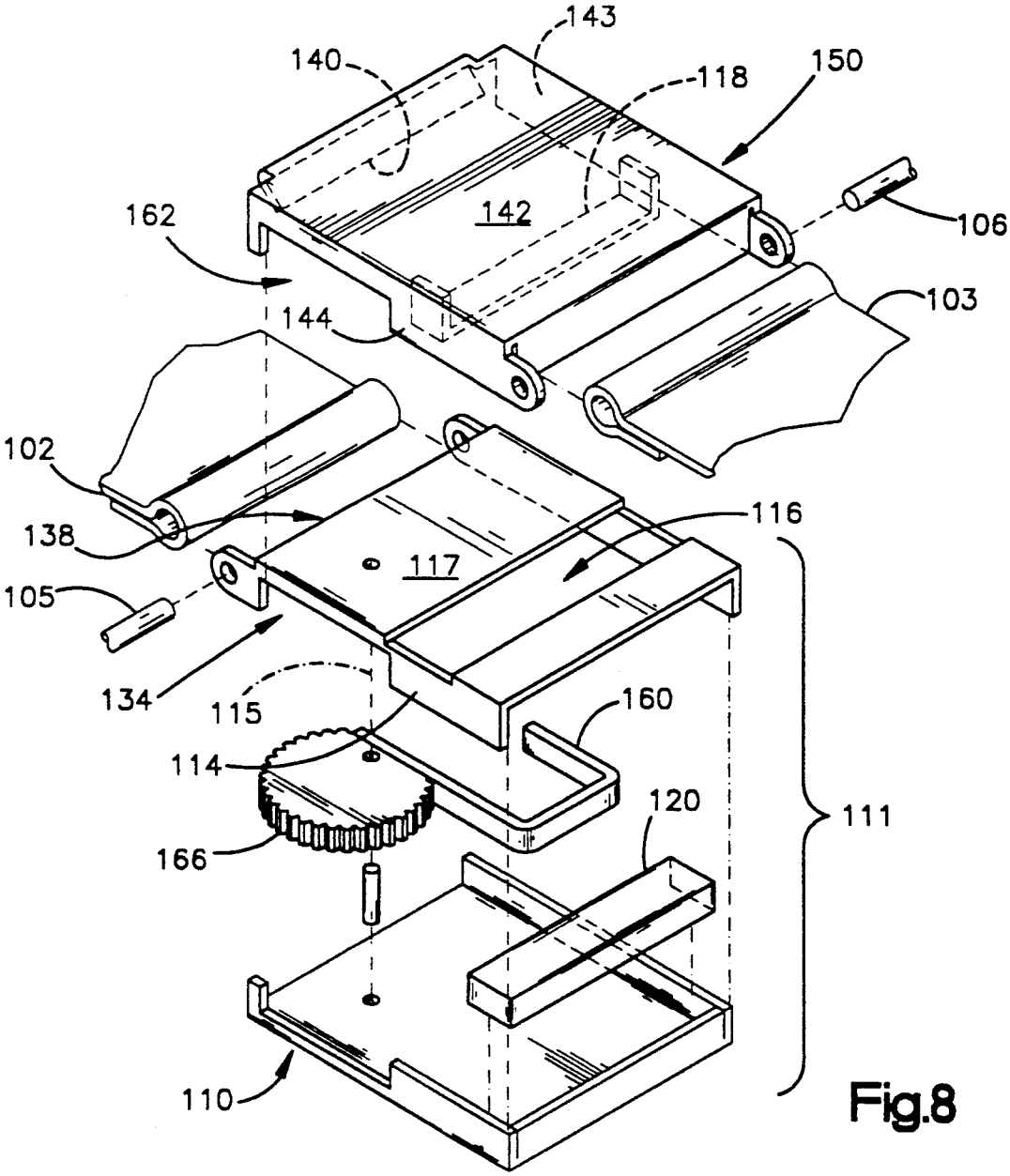
FIG. 8 presents an exploded perspective view of the embodiment shown in FIG. 6 to show all internal parts.

A second embodiment is shown in FIG. 6 in perspective. FIG. 6 shows this embodiment in partial cutaway with the keeper disengaged. FIG. 7 shows this embodiment in partial cutaway with the keeper engaged. In these figures, and especially in the exploded view shown in FIG. 8, it can be seen that the clasp includes a first element 110 that is a substantially closed box 111 attached at one end by a simple spring pin 105 to a first band end 102 and having a transverse opening 116 through its top wall 117 in a somewhat medial location and enclosing a permanent magnet 120 located at the end adjacent said opening 116. A keeper 160 made of magnetic material rotates within the box 111 on an axis 115 that runs through the thickness thereof in a manner that selectably puts the keeper 160 at a position where it is in close proximity to the magnet 120 and lies beneath the transverse top opening 116, as is shown if FIG. 7, or at a position away from the magnet 120 and well clear of the transverse top opening 116, as is shown in FIG. 6. A portion 166 of the keeper 160 extends through an opening 134 in the side wall 114 proximal to the pivot axis 115 to permit manual positioning the keeper by moving the extending portion 166, thereby to rotate the keeper about its axis 115.

The clasp of the second embodiment also includes a second clasp element 150 that comprises a cover top wall 142 and two cover side walls 143 144, together attached at one end by a simple spring pin 106 to a second band end 103. An extension of the cover top wall 142 forms a hook 140 to engage a transverse opening 138 in the first clasp element 111, in a manner as illustrated in the first embodiment. The second clasp element 150 includes a U-shaped shackle or stirrup 118 on the underside of the top wall 142 thereof and in a position where it may enter the transverse opening 116 in the first clasp element 110 after the hook portion 140 is engaged and as the cover portion 150 is lowered onto the box portion 111. Continued tension on the clasp from the two strap ends 102 and 103 would be sufficient to keep the clasp closed as the tension, coupled with pressure of the wearer's wrist against the bottom wall of the first clasp element, would prevent the second clasp element 150 from lifting up to allow disengaging the hook 140, but a locking device is desirable. A cutout 162 in the appropriate side wall 144 allows access to the keeper extension 166, so that the keeper 160 may be manually rotated to the locked position, in which it is adjacent the magnet 120 and held in place thereby, having passed through the stirrup 118. Thus, the keeper 160 prevents the stirrup 118 from being removed from the transverse opening 116. The stirrup being in the opening prevents motion of the cover element 150 in a direction that would permit disengaging the hook 140. The clasp is thus locked.

To unlock the clasp, the keeper 160 is manually rotated against the biasing force to the magnet 120 to the unlocked position, away from the magnet 120 and away from the transverse opening 116, freeing the stirrup 118 and allowing it to be lifted from the transverse opening 116 to then allow the hook 140 to be disengaged.

It is clear that changes could be made to both embodiments herein described. Also, other embodiments could be developed that would function equally as well as those herein described. Applicant views a key feature of his invention is the use of a magnetic biasing means to hold a mechanical keeper in place in a clasp or closure of the nature herein described. Further, the magnet and the keeper element can be in different separable parts of the clasp, as has been illustrated, or they can be in the same part of a clasp, as illustrated in the second embodiment herein presented.

I claim:

1. A closure for connecting a first and a second free end of a band as might be used as a strap on a wrist watch, said closure comprising:

a first clasp element adapted for attachment to said first free end and having a hook-receiving portion, a keeper-receiving portion, and a magnet;

a separable second clasp element adapted for attachment to said second free end and having a hook portion to be received by said first clasp element and a captive movable magnetic mechanical keeper;

wherein said hook portion engages said hook-receiving portion, said keeper engages said keeper-receiving portion, and said magnet provides a biasing force to urge said keeper to a position within said keeper-receiving portion wherein it participates in preventing said hook from disengaging from said hook-receiving portion, the closure thereby securely holds said free ends together.

2. A closure according to claim 1 further comprising:

said first clasp element comprising a box element adapted for attachment at one end thereof to said first band end, said box element comprising two box side walls, a transverse end hook-receiving opening proximal said first band end, and a top box wall having a first cutout creating a transverse opening therethrough that is coextensive with an L-shaped box opening in each said box side wall to form one continuous opening having a side wall portion thereof that is longitudinal, and a magnet beneath said box top wall at the end thereof proximal said first band end;

said second clasp element comprising a cover element adapted for attachment at one end thereof to said second band end and comprising two cover side walls, and a cover top wall, said cover top wall comprising a hook portion distal from said second band end and adapted to engage said transverse end opening in said box element, a magnetic keeper slidably but captively held at each end thereof within paired longitudinal openings in said cover side walls, which said longitudinal openings may be placed in registry with corresponding longitudinal portions of said L-shaped box openings while said hook portion is engaged with said transverse box end opening; wherein, when said hook portion of said cover element engages said transverse end opening of said box element and said cover element covers said box element, said keeper may pass through said transverse top box wall and into said two L-shaped box openings and, under the biasing influence of said magnet, be drawn slidably within said registered longitudinal openings to the end of said openings proximal said magnet, thereby to prevent the lifting of said cover element from said box element to inadvertently disengage said hook portion from said transverse box end opening, the closure then securely holds said free ends together.

3. A closure for connecting a first and a second free end of a band as might be used as a strap on a wrist watch, said closure comprising:

a first clasp element adapted for attaching to said first free end and having a hook portion and a stirrup portion; and a separable second clasp element adapted for attaching to said second free end and having a hook-receiving portion to receive the hook of said first clasp element, a stirrup-receiving portion, a movable captive magnetic keeper, and a magnet;

wherein said hook portion engages said hook-receiving portion, said stirrup engages said stirrup-receiving portion, said keeper engages said stirrup, and said magnet provides a biasing force to urge said keeper to a position wherein, by preventing said stirrup from disengaging from said stirrup-receiving portion, said keeper thereby prevents said hook from disengaging from said hook-receiving portion, the closure thereby securely holds said free ends together.

4. A closure for connecting a first and a second free end of a band as might be used as a strap on a wrist watch, said closure comprising:

a first clasp element adapted for attachment to said first free end and comprising a box element comprising a hook-receiving portion proximal to said first free end and an end wall distal from said first free end;

a separable second clasp element adapted for attachment to said second free end and comprising a hook portion distal from said second free end, said hook to be received by said first clasp element, a top cover wall, and a rear cover wall adjacent said second free end;

a magnet; and a movable magnetic mechanical keeper movably retained by one said clasp element;

wherein a biasing force from said magnet urges said keeper to a position in which said keeper participates in keeping said hook engaged with said hook-receiving portion to retain said clasp elements in an engaged condition by keeping said top cover wall sufficiently close to said box element to trap said box element between said hook portion and said rear cover wall.

5. The closure of claim 4 wherein said magnet is a part of one clasp element and said magnetic mechanical keeper is a part of a different clasp element.

6. The closure of claim 5 comprising: said second clasp element further comprises said captive movable magnetic keeper; and said first clasp element further comprises a keeper-receiving portion and said magnet; wherein said hook portion engages said hook-receiving portion, said keeper engages said keeper-receiving portion, and said magnet provides a biasing force to urge said keeper to a position within said keeper-receiving portion wherein it participates in preventing said hook from disengaging from said hook-receiving portion, the closure thereby securely holds said free ends together.

7. A closure according to claim 6 further comprising:

said box element further comprising two box side walls and said top box wall having a first cutout creating a transverse opening therethrough that is coextensive with an L-shaped box opening in each said box side wall to form one continuous opening having a side wall portion thereof that is longitudinal, and a magnet beneath said box top wall at the end thereof proximal said first band end;

said second clasp element further comprising two opposing cover side walls and a magnetic keeper slidably but captively held at each end thereof within paired longitudinal openings in said cover side walls, which said longitudinal openings may be placed in registry with corresponding longitudinal portions of said L-shaped box openings while said hook portion is engaged with said hook-receiving portion;

wherein, when said hook portion of said cover element engages said hook-receiving portion of said box element and said cover element covers said box element, said keeper may pass through said transverse top box wall and into said two L-shaped box openings and, under the biasing influence of said magnet, be drawn slidably within said registered longitudinal openings to the end of said openings proximal said magnet, thereby to retain said clasp elements in an engaged condition by keeping said top cover wall sufficiently close to said box element to trap said box element between said hook portion and said rear cover wall.

8. The closure of claim 4 wherein said magnet is a part of one clasp element and said magnetic mechanical keeper is a part of the same clasp element.

9. A closure according to claim 8 wherein said second clasp element further comprises a stirrup portion and said first clasp element further comprises a stirrup-receiving portion, a movable captive keeper, and a magnet, wherein said hook portion engages said hook-receiving portion, said stirrup engages said stirrup-receiving portion, said keeper engages said stirrup, and said magnet provides a biasing force to urge said keeper to a position wherein, by preventing said stirrup from disengaging from said stirrup-receiving portion, said keeper thereby prevents said hook from disengaging from said hook-receiving portion by keeping said top cover wall sufficiently close to said box element to trap said box element between said hook portion and said rear cover wall.

* * * * *